United States Patent [19]

Goodley et al.

[11] Patent Number: 4,583,533

[45] Date of Patent: Apr. 22, 1986

[54] ORTHOPEDIC LUMBAR APPARATUS

[76] Inventors: Paul H. Goodley, 349 S. Lafayette Pl., Apt. #328, Los Angeles, Calif. 90057; Alexander M. Shemet, #2 Empty Saddle Rd., Rolling Hills Estates, Calif. 90274

[21] Appl. No.: 549,995

[22] Filed: Nov. 8, 1983

[51] Int. Cl.[4] ..... A61H 1/02

[52] U.S. Cl. ..... 128/75; 128/68; 272/900

[58] Field of Search ..... 128/75, 68; 272/900, 272/134; 297/463, 452, 250; 135/65, 67, 68

[56] References Cited

U.S. PATENT DOCUMENTS 1,614,641 1/1927 Anderson ..... 128/75
4,030,489 6/1977 Bucknee ..... 128/75

FOREIGN PATENT DOCUMENTS 2410839 9/1975 Fed. Rep. of Germany ..... 128/75

*Primary Examiner*—Richard J. Apley
*Assistant Examiner*—Alan W. Cannon
*Attorney, Agent, or Firm*—Edward A. Sokolski

[57] ABSTRACT

A method and apparatus for relieving or preventing back pain and therapeutically treating back ailments by exerting suspensory force on the torso in the rib cage region through the connection of opposing sides of that region each to a strut which rests upon a surface on which the wearer is sitting or standing and is of a sufficient length to bear at least a portion of the body weight, thereby relieving weight from the lumbar region of the spine and further for cyclically stretching the lumbar region of the spine. The connection is made by means such as two corselets which are attached to struts, the lower ends of which form feet to rest on the surface on which the wearer is seated or is standing. Inhalation and exhalation and tightening or releasing of the stomach muscles by the wearer serve to cyclically increase the suspensory force and apparatus for mechanically assisting in this cyclical variation is provided.

8 Claims, 9 Drawing Figures

ORTHOPEDIC LUMBAR APPARATUS

FIELD OF THE INVENTION

The present invention relates to an orthopedic apparatus for supporting, lifting and stretching the lumbar region of the spine in order to provide relief from back pain or otherwise to support the lumbar region of the back for a wearer of the apparatus who has suffered some back injury or has some back defect.

BACKGROUND AND SUMMARY OF THE INVENTION

It is known in the art that stretching of the back can provide relief from back pain, particularly in the lower or lumbar region of the spine. Also, it is known that such stretching may have a therapeutic, as well as pain relieving function, for certain back injuries to the lumbar region of the spine, as well as certain congenital spinal maladies, e.g., scoliosis.

In the past it has been common to stretch the spine by exerting opposing forces on the body at locations of the body above and below the lumbar region. For example, orthopedic tables are known which provide for attachment of the shoulder or chest region of the patient to one portion of the table movable with respect to the other portion of the table, to which the hips, thighs or lower legs of the patient are attached. Stretching of the spine is accomplished in a cyclical fashion by movement of the movable portion of the table with respect to a static portion of the table, or moving both portions of the table in opposite directions at the same time, while periodically reversing the motion to relieve the tension created on the lumbar region of the spine.

It has also been common in the art to exert opposing forces on portions of the body above and below the lumbar region, both for back support, pain relief and therapeutic purposes. Examples of such devices can be seen in the following U.S. Pat. Nos. 1,722,205 to Freund; 2,835,247 to Stabholc; 2,687,129 to Talkish; 3,799,156 to Gurkin; and 3,889,664 to Heuser et al.

It is further known as common in the art to provide devices for prophylactic purposes which reduce forces or loads other than body weight on the lumbrosacral area by transmitting part of the load through the pelvic and infrapelvic structure to the floor. Examples of such devices can be seen in U.S. Pat. Nos. 4,211,219 to Alvey and 1,384,299 to Brown.

In addition, it has been known to suspend the human body above the floor, either hanging from the feet or ankles or hanging from the underarms or rib cage area, utilizing the force of gravity in order to stretch the lower spine.

The stretching tables and suspending devices require that the patient dedicate a certain time for therapy in which other activity is substantially proscribed. In addition, such therapy normally occurs at the office of a doctor or physical therapist, unless the patient can afford to, and has the space to, install expensive and/or bulky equipment in the home.

The form of apparatus for stretching or bracing which involves exerting force on two areas of the body above and below the lumbar spinal region, to force those two areas away from each other, also suffers from a number of inadequacies. Such braces, as can be seen from the art, are relatively bulky and can be quite uncomfortable to the wearer, exerting as they do, force on two different body areas to stretch the spine. In addition, the static stretching, once the brace is adjusted to exert a certain force between the two areas of attachment to the body, remains essentially constant unless and until the brace is readjusted.

It is known that the cyclical stretching of the spine can be more beneficial, thus the desirability of the use of, e.g., stretching tables as noted above, which have, however, the inconveniences noted above. It is also known that relieving the force of gravity on the spine created by the spine supporting the upper body can be beneficial, as demonstrated by the suspension-type apparatus noted above which also serves to stretch the spine. But, these have the disadvantages noted above. However, such suspension is noted to be very beneficial, at least in relieving back pain, and may be as or more therapeutically beneficial than the static braces and/or the stretching tables.

The problems enumerated in the foregoing description of the prior art are not intended to be exhaustive, but rather are among many which tend to impair the effectiveness of previously-known apparatus for relieving back pain and therapeutically treating back ailments. Other noteworthy problems may also exist; however, those presented above should be sufficient to demonstrate that apparatus for treating back pain and therapeutically treating back ailments appearing in the prior art have not been altogether satisfactory.

SUMMARY OF THE FEATURES OF THE PRESENT INVENTION

While such arrangements noted above in the prior art have exhibited at best a degree of utility in relieving back pain and therapeutically treating back ailments, room for significant improvement remains.

Recognizing the need for an improved apparatus for relieving back pain and therapeutically treating back ailments, it is therefore a general object of the present invention to provide a novel torso suspension apparatus which minimizes or reduces the problems of the type previously noted. It is a more particular feature of the present invention to provide a torso suspension apparatus which combines the relative mobility of a brace-type apparatus with the more therapeutically beneficial results of the suspension-type apparatus, and at the same time, incorporates a capability of cyclically varying the stretching of the spine.

A feature of the present invention resides in the use of a portion of the apparatus of the present invention which fits snugly against the region of the body of the wearer in the vicinity of the upper portion of the lumbar region of the spine, e.g., a pair of corselets which snugly fit adjacent each side of the lower rib cage of the wearer. These corselets are attached to respective struts which extend in the direction of the hips of the wearer, and are of a sufficient length to rest against a surface on which the wearer is sitting or standing, and provide a suspension force holding up the rib cage against the force of gravity, to relieve the amount of upper body weight being supported by the spine. This suspending force, in addition, tends to stretch the spine of the wearer.

A further feature of the present invention resides in pivotally connecting the struts to the corselets and providing a foot at the terminal end of each strut of such shape as to, in connection with its pivotal attachment to the corselet, allow the wearer sitting in a chair to have a degree of forward and backward movement associated with bending the torso at the hips or rotational movement in turning the upper torso or a combination thereof. This allows the wearer to, e.g., use the apparatus while working at a desk job or use the apparatus while sitting at home in a chair, e.g., eating at a table or watching television.

Yet another feature of the present invention is that it will inhibit compression such as shocks to the lumbar spine when the wearer is, e.g., sitting in a vehicle moving over rough terrain or in aircraft when gravity forces or air turbulences are being experienced. This is therefore a prophylactic as well as therapeutic instrumentation.

It is another feature of the present invention that the struts may be positioned at a slight angle to the vertical, with each respective foot positioned outside of a vertical line extending from the point of connection of the strut to the corselet and to the chair. In this manner, respiratory inhalation by the wearer of the apparatus of the present invention will tend to expand the corselets outwardly to a degree dependent on depth of inhalation and move the point of connection into a vertical line over each respective foot, or more closely to a vertical line over the foot. This effect further increases suspension of the rib cage area tending to both further relieve the weight on the spine and further stretch the spine.

A further feature of the present invention is that with the apparatus in place as previously described, a tightening of stomach muscles increases the intra-abdominal pressure which raises internal body organs and translates a portion of their weight into further pressure against the corselets—amplifying the suspensory action.

Yet another feature of the present invention relates to employing a strut length adjusting apparatus which enables the apparatus of the present invention to be adjustable for the particular size of various patients.

Yet a further feature of the present invention relates to securing the feet of the struts from slipping forwardly or rearwardly on the seat in which the wearer is sitting.

Yet still another feature of the present invention relates to use of the apparatus of the present invention in conjunction with a means for moving the struts into and out of a generally vertical position in a cyclical fashion to assist in obtaining the effect noted above resulting from either deep inhalation or a tightening of stomach muscles by the wearer.

Yet still a further feature of the present invention involves the use of the apparatus of the present invention attached to the seat back of, for example, an automobile seat, in which the wearer might be expected to be seated for long periods of time.

Yet a further feature of the present invention resides in extending the length of the struts to in effect form crutchlike struts attached to the corselets to achieve the effect of the present invention when the wearer is in the standing position.

The apparatus of the present invention is particularly suited to use by a patient in a sitting or standing position. Clinically, compressive forces of gravity on the lumbar spine region increase with sitting or standing. This limits the ability of patients with lumbar pain to remain in a standing or sitting position for any length of time. This may prevent such patients from achieving comfort and even from returning to gainful employment. It has been found that many patients may be essentially relieved from pain by relieving approximately 10 to 15 pounds of the lumbar compressive forces. The apparatus of the present invention provides that function by fitting about the patient's waist and lower rib cage region and supporting the patient between the struts which serve to sustain a portion of the total body weight.

Examples of the more important features of the present invention have thus been summarized rather broadly in order that a detailed description thereof that follows may be better understood, and in order that the contribution to the art may be better appreciated. There are, of course, additional features of the invention that will be described hereinafter and which will form the subject of the appended claims.

BRIEF DESCRIPTION OF THE DRAWINGS

Other features and advantages of the present invention will become apparent with reference to the following detailed description of a preferred embodiment thereof in connection with the accompanying drawings, wherein like reference numerals have been applied to like elements, in which.

DETAILED DESCRIPTION OF A PREFERRED EMBODIMENT OF THE INVENTION

Figure 1:
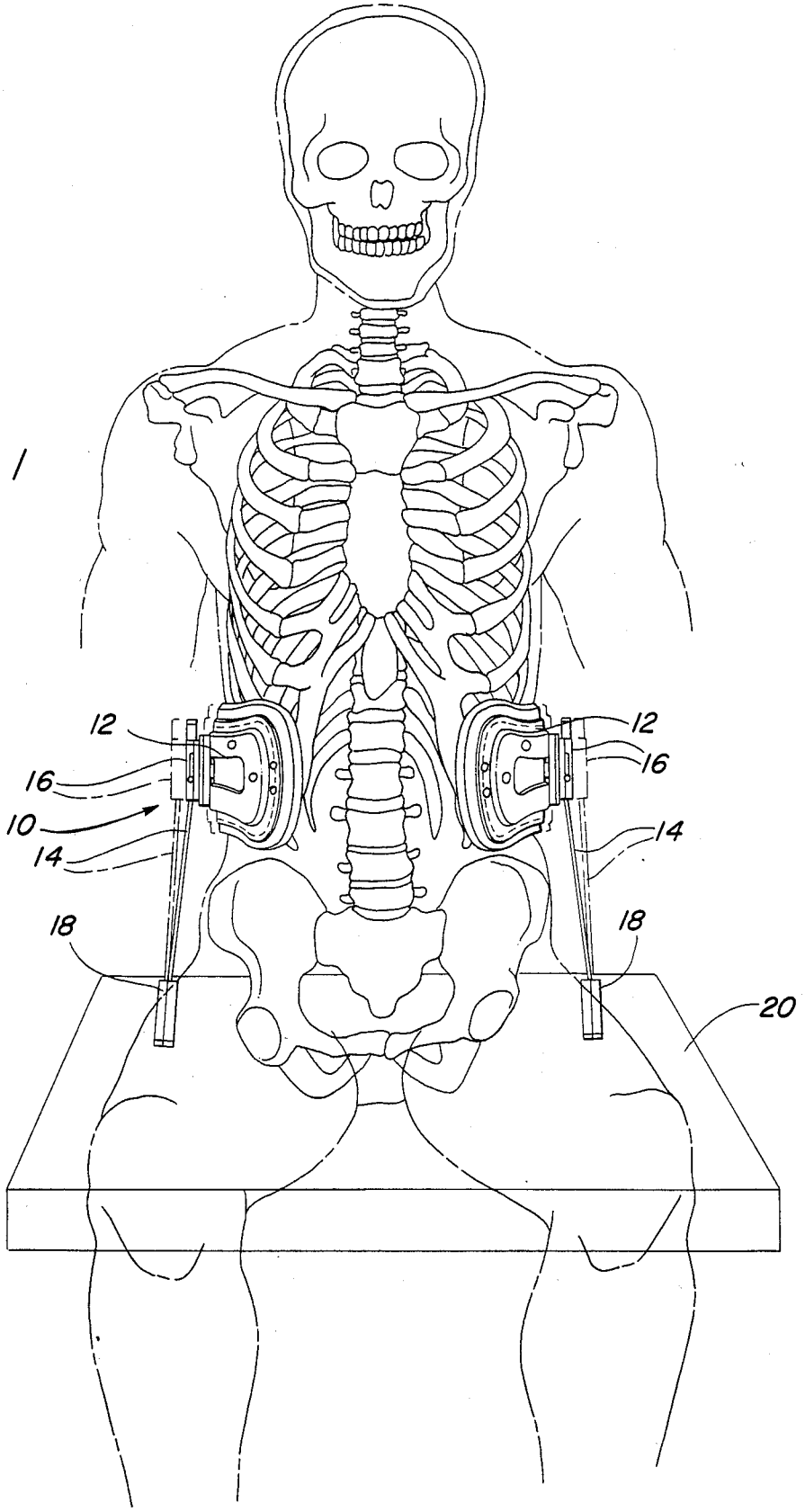
FIG. 1 depicts a torso suspending apparatus according to the present invention and its position on the body of the wearer in a sitting position. It also illustrates in phantom the effects of deep breathing by the wearer to align the struts to a more vertical position, thereby increasing the upward lift on the rib cage portion of the torso, against which the corselets of the present invention exert pressure.

Turning first to FIG. 1, there is shown a torso suspension apparatus according to the present invention generally designated as 10. The torso suspension apparatus 10 is shown to contain a pair of corselets 12 which are positioned between the hips and the lower rib cage of the wearer and held snugly there, as further described below. The corselets 12 are each connected to a respective strut 14 at a strut mounting 16, with the terminal end of the strut 14 forming a respective foot 18. The foot 18 rests upon the surface of a seat, for example, a bench 20 as shown in FIG. 1, upon which the wearer is sitting. The length of the strut 14 from the point of attachment at the strut mounting 16 to the point of contact of the foot 18 is such that the amount of weight on the buttocks of the wearer will tend to be reduced. This results from the suspension of some of the upper body weight through the rib cage of the wearer and the corselets and struts to the seat and thus relieves upper body weight from the lumbar region of the spine and stretches the lumbar region. It can also be seen in FIG. 1, that deep inhalation by the wearer, which will tend to expand the corselets 12 outwardly to the position shown in phantom in FIG. 1, will result in the struts 14 being more aligned to a vertical position. This effectively increases the transfer of upper torso weight of the wearer to the corselet/strut combination, further relieving the pressure on the spine and further stretching the spine. It has been found, in tests in which the wearer of an apparatus 10 constructed according to the present invention was seated on a scale, that the apparent reduced weight on the buttocks of the wearer from movement of the struts from a less vertical to a more vertical position may be as much as 10 to 20 pounds. This is in conjunction with the already existing apparent reduced weight on the wearer's buttocks resulting from suspension of additional upper body weight through the rib cage, corselets and struts to the feet 18 of the struts 14 rather than fully on the buttocks. Exhalation by the wearer restores the weight on the buttocks of the wearer to that existent before deep inhalation. Repetitive inhalation and exhalation generates the cyclical effect. Thus, an effect similar to the cyclical stretching of the spine, on, e.g., a stretching table, can simply and easily be achieved utilizing the apparatus of the present invention without the necessity of strapping a patient to a table having portions movable with respect to each other and the concomitant inconvenience and necessary time away from other activities required by treatment on such tables. Further, the pivotal attachment 16 of the struts 14 and the curved surface of the foot 18 permit rotation of the torso by forward and backward rocking or a combination thereof. Furthermore, even without employing the ability to cyclically vary the upward force, the torso suspender 10 provides for stretching the spine and relieving upper body weight from the lumbar region of the spine without the need for the suspension of the entire body from a suspension apparatus or the use of static braces.

Figure 2:
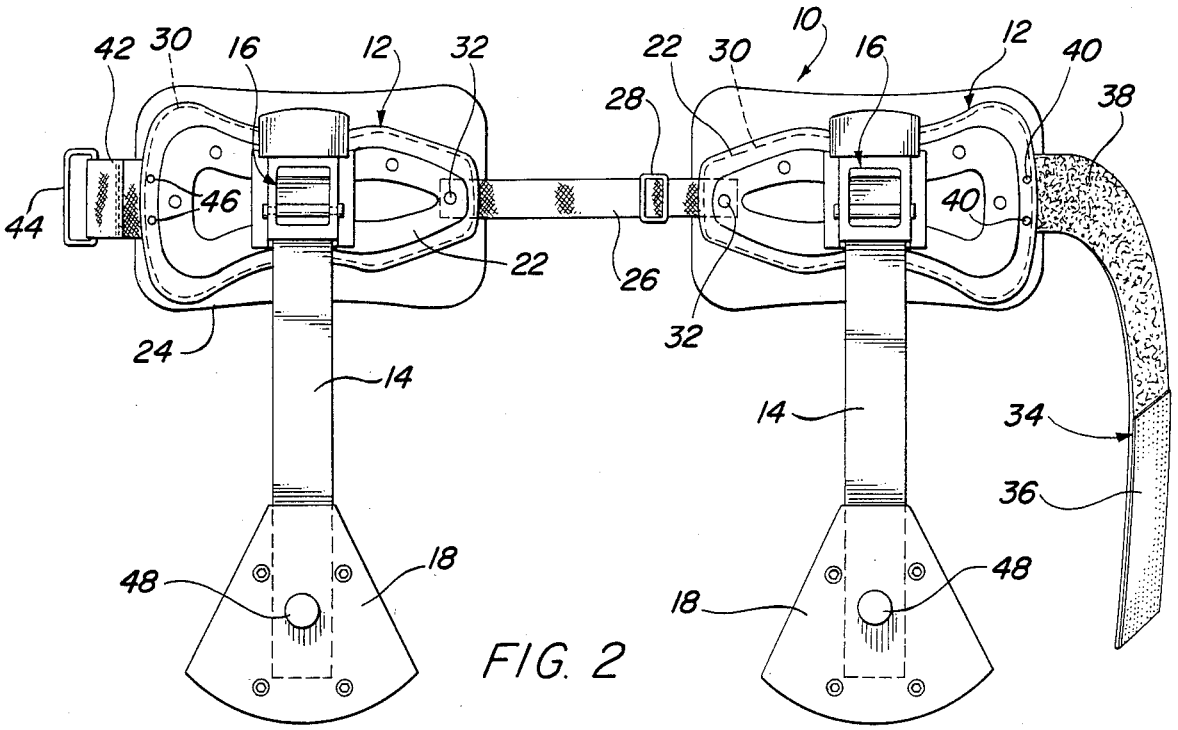
FIG. 2 shows a perspective view of the apparatus of the present invention with the corselets laid side by side showing the component parts of the lumbar lifting apparatus of the present invention.

FIG. 2 illustrates in more detail the torso suspender apparatus 10 of the present invention. The corselets 12 are constructed of a relatively stiff and durable material, e.g., polyvinylchloride plastic, which at the same time has some flexibility. The plastic 22 is attached to a foam padding 24 by, for example, stitching 30, with the plastic 22 and padding 24 being shaped to conform generally to the lower rib cage region of the body. Such pads are relatively common in use to protect the ribs and abdominal organs of participants in contact sports, for example, football. Each corselet 12 is connected by a posterior web belt 26 having an adjusting buckle 28 with either end of the belt 26 extending between the pad 24 and the plastic 22 and attached to the corselets by the stitching 30 in the region of attachment, and additionally by an attachment rivet 32.

The anterior portion of the apparatus 10 has a cinch belt 34 which contains approximately one-half of its length as a material 36 containing velcro hooks and the other half of its length as a material 38 containing velcro. The cinch belt 34 is connected to one of the corselets 12 in a manner similar to the web belt with the addition of two rivets 40. The other corselet 12 has attached to it in a similar fashion an attachment belt 42 at the end of which is a D ring 44, with the attachment belt 42 being additionally supported by two rivets 46. The cinch belt 34 is passed through the D ring 44 and fastened to itself in adjusting the lumbar lift apparatus 10 to snugly fit at the lower rib cage region of the wearer.

Figure 3:
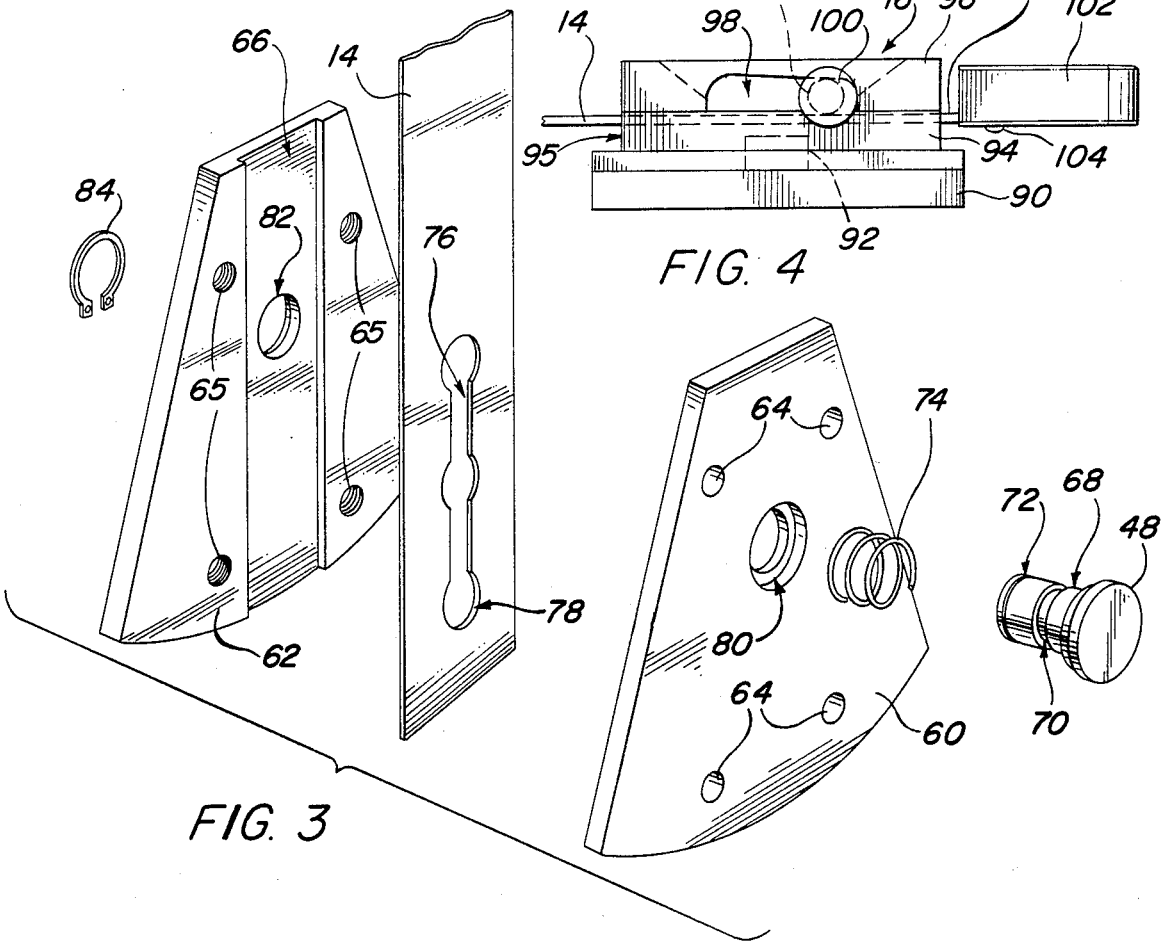
FIG. 3 shows an exploded view of the component parts of a foot attached to the end of one of the struts illustrating a mechanism for adjusting the position of the strut at which the foot is attached, to thereby facilitate varying the overall length of the strut/foot combination in fixed increments of length.

A detail of the foot 18 attached at the terminal end of each strut 14 is shown in exploded view in FIG. 3. FIG. 3 shows a strut adjuster button 48, the detail of which is described further below. Each foot 18 has a front plate 60 and a back plate 62 which are joined together by screws (not shown) passing through holes 64 and into threaded holes 65 in the back plate 62. On the facing surface of each of the back plates 62 is a slot 66 into which the terminal end of the strut 14 slidably fits. The strut adjuster button 48 has a shaft 68 with a circumferential groove 70 contained therein. The width of the circumferential groove 70 is sufficient to allow the shaft 68 to slide along the slot portion of opening 76. Opening 76 is at generally the terminal end of the strut 14. The strut adjuster button has a locking pin groove 72 at generally its terminal end, with the outer diameter of the shaft between the locking pin groove 72 and the circumferential groove 70 being of generally the same outer diameter as the upper portion of the shaft 68. A spring 74 is disposed between the strut 14 and the front plate 60, and surrounds and engages a portion of the adjusting pin 48, when the adjusting pin 48 is inserted into an opening 80 on the front plate 60. The adjuster button 48 is also inserted through an opening 82 on the back plate 62 and held in place by the C ring 84.

It will be seen, that the spring loading of spring 74 urges the portion of the shaft between the locking pin groove 72 and circumferential groove 70 into one of the circular openings 78 in the opening 76 when the adjuster button 48 is in alignment with one of the circular openings 78. In order to change the position of the foot 18, the adjuster button 48 is pushed inwardly against the urging of spring 74 from the front plate 60 until the circumferential groove 70 is aligned with the strut 14, thereby enabling the button 48 to be moved along the slot portions of the opening 76 until the shaft 68 is aligned with a different selected circular opening 78. At this point the adjuster button 48 is released and allowed to move in the direction of urging by the spring 74 to lock the foot 18 in the new desired position.

Figure 4:
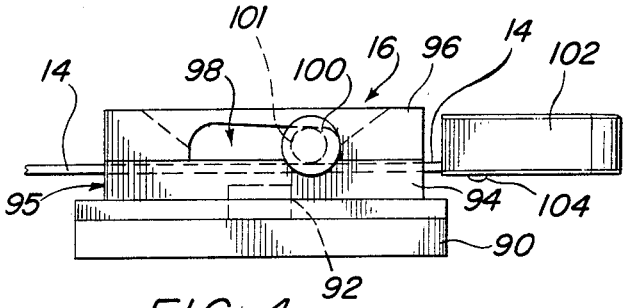
FIG. 4 is a side view of a pivotal mounting and strut length adjustment apparatus according to the present invention which provides for pivotally mounting the strut on the corselet and, further, for adjusting in variable increments the length of the strut between the length adjusting mechanism and the foot, and locking the strut in a position for maintaining that length.

FIG. 4 illustrates a pivotal mounting 16. The pivotal mounting 16 has a mounting plate 90 which is attached, e.g., by screws or rivets (not shown) to the plastic 22 of the respective corselet 12, at generally the central portion thereof. A pivot pin 92 pivotally attaches the inner half 94 of a pivotal mounting 95 to the mounting plate 90. An outer half 96 of the pivotal mounting 95 is attached, for example, by screws (not shown), to the inner half 94. The outer half 96 is formed with a slot through which the strut 14 passes as shown in FIG. 4. The outer half 96 has a hollowed interior with the side walls of the outer half 96 forming respective tapered slots 98 aligned generally with the strut 14. A nylon roller 100 extends through each tapered slot 98 and across the surface of the strut 14. The nylon roller 100 has a narrowed portion 101, shown in phantom in FIG. 4, in the interior vicinity of the side walls of the upper half 96 of the pivotal mounting 95. It will be seen, that the nylon roller 100 when moved in a direction to the left, as shown in FIG. 4, toward the broadest part of the tapered slot 98, will release pressure on the surface of the strut 14 and allow the strut 14 to slide in the slot formed in the outer half 96. The strut 14 is prevented from sliding fully through the slot in the outer half 96 by a stop block 102 which is fastened to the terminal end of the strut 14 by, for example, a screw 104. When the strut 14 is at a position such that the length between the pivotal mounting 95 and the foot 18 is a desired length, the nylon roller pin 100 can be moved to the right-hand portion of the slot 98 as far as is possible, with the wedging action serving to lock the strut 14 in the desired position. It will be further understood that placing weight on the apparatus 10 by the wearer putting on the apparatus 10 and sitting down with a respective foot 18 resting on the surface upon which the wearer is sitting will further wedge the nylon roller 100, serving to further lock the strut 14 in the desired position.

Figure 5:
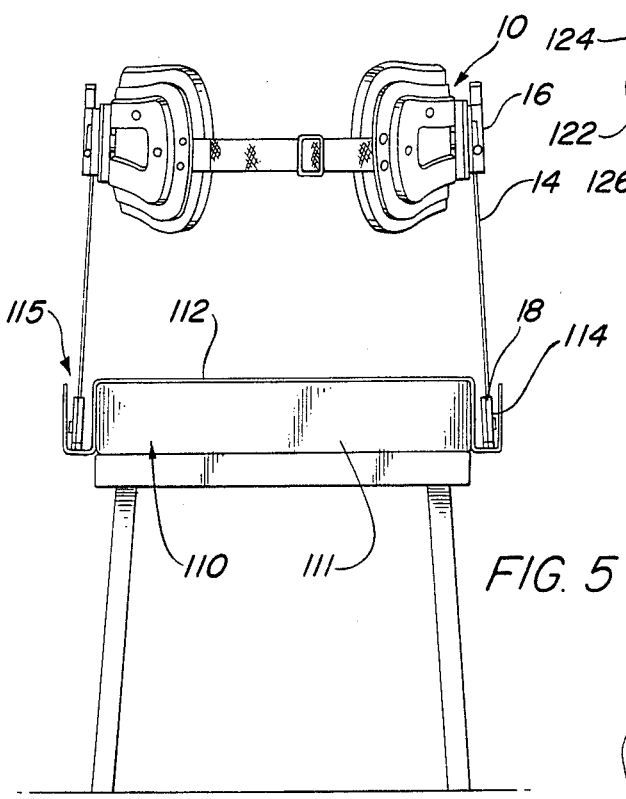
FIG. 5 illustrates the use of an additional strap having a pouch at either end which is placed over a seat on which the wearer is sitting, with each foot being inserted into a respective pouch to more positively hold the respective foot in the event that the material of the seat is not conducive to preventing the feet on the struts from sliding forwardly, rearwardly or sidewardly.

FIG. 5 is a schematic representation of an additional apparatus which may be used along with the present invention when the surface upon which the wearer of the torso suspension apparatus 10 is to sit is made of a material which does not facilitate holding the feet 18 against forward, rearward or even sideward slippage. This might occur if the chair 110 has a fabric cushion 111. The plastic material of the feet 18 might tend to slip on certain fabrics. Therefore a strap 112 is provided which is of a, for example, woven material, which may be nylon, cotton or the like, and which contains at either end thereof a pouch 114. The strap 112 is of a sufficient length such that the pouches will extend vertically downwardly over the sides of the chair seat 110. The pouches are of a sufficient size to receive and hold a respective foot 18. It will be seen that when the wearer is seated in the chair with the strap 112 running under the buttocks of the wearer and in the pouches receiving and holding their respective foot 18 a downward force on the struts 14 will be acting against the strap 112 across the entire seat cushion 111 and the feet 18 on the struts 14 will be prevented from forward, rearward or sideward or downward slippage.

Figure 6:
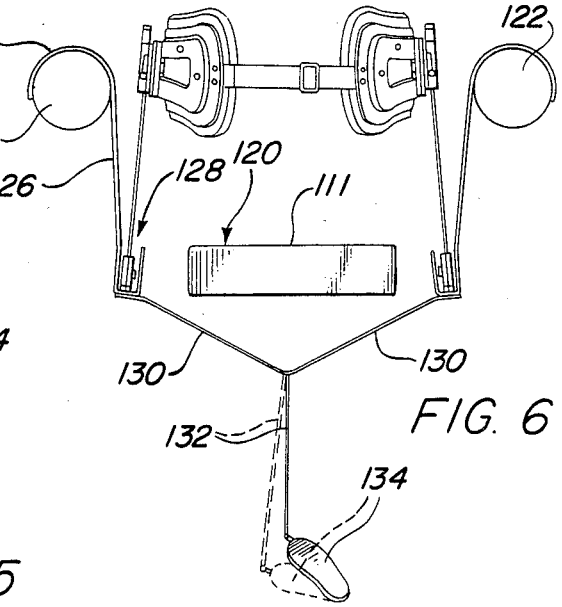
FIG. 6 shows an alternative embodiment useful with an armchair in which straps are suspended from the arms of the armchair each containing a pouch into which a respective foot is inserted. The pouches have some mechanism attached to them to alternately draw the pouches inwardly and release the pouches, allowing them to move outwardly, thereby assisting in the effect similar to that created by the deep inhalation of the wearer, by moving the struts to a more vertical position and away from that more vertical position upon exhalation by the wearer, thereby cyclically increasing and decreasing the torso suspending action.

FIG. 6 shows a slight modification of the embodiment of FIG. 5 with an additional feature added to assist the wearer in the cyclical modification of the suspension force, which can be accomplished also by the deep inhalation and exhalation of the wearer as noted above. In the embodiment of FIG. 6 the torso suspension apparatus 10 of the present invention is shown utilized in conjunction with an armchair 120 having two arms 122 in which an opening exists between the seat cushion 111 of the armchair 120 and the arms 122. An example of such a chair might be what is called a "captain's chair." A pair of curved holding plates 124 are each attached to a respective strap 126 with the opposite end of the strap 126 having a pouch 128 which receives and holds the respective foot 18. It will be seen that the wearer seated in such an armchair 120 with the feet 18 of the struts 14 inserted into the pouches 128 will result in the pouches tending to orient themselves vertically directly below the inside edge of the respective arm 122 over which the respective curve plate 124 passes. An apparatus is provided for applying a force on the pouches 128 to urge the pouches 128 to a position more directly aligned with a vertical line downwardly from the mounting 16 of each strut 14. This apparatus includes a pair of pulling lines 130 attached at one end to the respective pouches 128 and at the other end to a single pulling line 132. The single pulling line 132 is attached to an apparatus, e.g., a foot pedal 134, for applying a downward force on the single pulling line 132. This in turn draws the pouches 128 towards each other and accomplishes the desired increase in lifting force on the corselets 12. Releasing the pressure on the foot pedal 134 allows the pouches 128 to again seek the position of the pouches 128 shown in FIG. 6.

Figure 7:
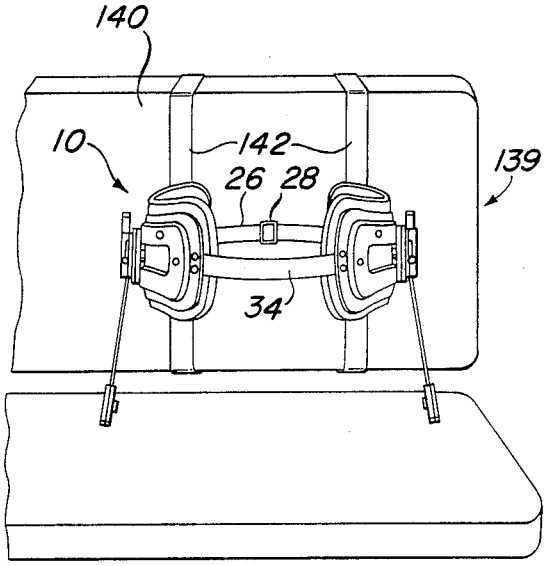
FIG. 7 illustrates the torso suspension action of the present invention permanently mounted on the seat back of, for example, a car seat.

FIG. 7 shows an embodiment of the present invention which may be used in conjunction with a seat, for example, a car seat 139 having a car seat back 140, in which seat 139 the wearer of the apparatus might be expected to be seated for extended periods of time. The corselets 12 are permanently attached to car seat back 140 by straps 142 which pass around the car seat back 140 and may be anchored to the floor of the vehicle behind the car seat 139. It will be understood that the apparatus of the present invention need not necessarily be permanently affixed to the straps 142, with the same effect being capable of being accomplished by undoing the buckle 28 on the webbed belt 26, as shown in FIG. 2, and passing the webbed belt 26 around straps 142 that are permanently affixed to the car seat back 140. This provides a combined use of the torso suspender 10 with an auto safety harness.

Figure 8:
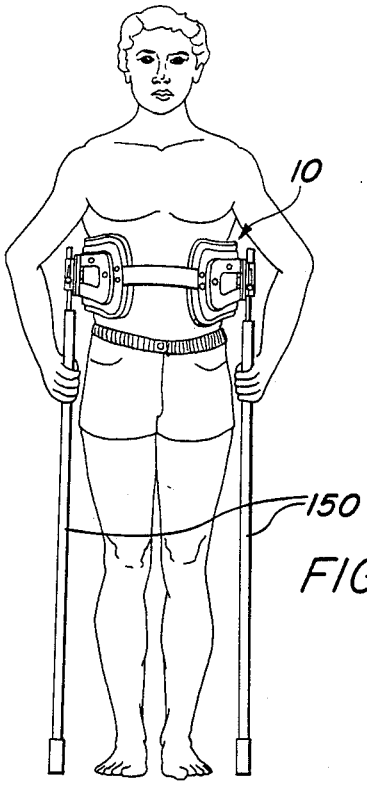
FIG. 8 illustrates an embodiment of the present invention in which the struts are elongated to rest on the ground to support the wearer and stretch the spine of the wearer when the wearer is in a standing position.

The apparatus 10 of the present invention might also be used for taking a portion of the strain from the lower back of an individual whose working environment requires a good deal of standing. In the embodiment shown in FIG. 8, the struts 14 of the embodiment shown in FIG. 2 have been elongated into crutchlike struts 150 with the feet 18 of these crutchlike struts 150 being intended to rest upon the floor upon which the wearer is standing. It will be understood that such an apparatus having pivotal attachment to the corselets 12 of the struts 150 and having hand brackets (not shown) in the struts 150 or hand grips (not shown) attached to the struts 150 could also be conveniently used for relieving pressure on the lumbar region when the wearer is walking. The struts 150 would then be used in a fashion similar to crutches, with the exception that the weight of the wearer is borne by the rib cage as opposed to the armpits and arms as with crutches of the usual design.

Figure 9:
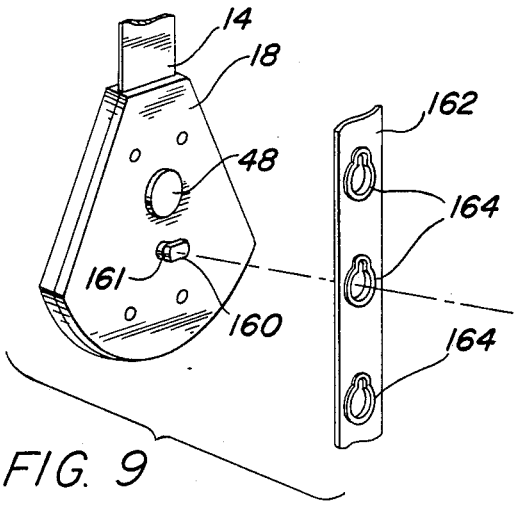
FIG. 9 illustrates a possible alternative to the use of the pouches as shown in FIGS. 5 and 6.

FIG. 9 shows an alternative to the use of the pouches 114, 128 shown in FIGS. 5 and 6. Each foot 18 has attached thereto a cleat 160 extending outwardly from the front face 60 of the foot 18. The cleat 160 may be of T-shape having a shaft 161. A modified strap 162 has a plurality of pear-shaped eyelets 164 of durable plastic or metal material sewn, stamped or otherwise formed in the strap 162, leaving reinforced pear-shaped openings. The circular portion of the pear-shaped opening is of a sufficient size to allow the cleat 160 to pass through. The narrower portion of the pear-shaped opening of the eyelet 164 will then hold and lock on the cleat 160 by receiving its shaft 161 with the cross-bar of the T extending to either side of the narrower portion of the pear-shaped opening. The opposite end of the strap 162 need have only one eyelet 164 to attach to a similar cleat 160 on the opposite foot 18, with length adjustment being accomplished by selecting one of the eyelets 164 at the opposite end of the strap 162. A groove may be cut in the base of each foot to receive the strap 162 and lock the respective foot directly over the transverse extension of the strap below the buttocks of the wearer.

SUMMARY OF THE ADVANTAGES AND SCOPE OF THE INVENTION

It will be appreciated that in constructing a torso suspension apparatus 10 according to the present invention, certain significant advantages are provided. In particular, an apparatus is provided for relieving upper body weight from, and for stretching, the lumbar region of the spine which is simple to construct, easy and comfortable to wear and allows for a reasonable degree of freedom of the wearer to conduct normal working or living activities, especially in the seated or standing position. The apparatus provides for relief of upper body weight from and for stretching of the lumbar region of the spine without the need for braces operating through opposing forces exerted on two different body regions above and below the lumbar region of the spine. This enables the beneficial results of a suspension stretching apparatus according to the prior art while the wearer, e.g., remains seated, and without hanging the entire body (right side up or upside down) from a suspension apparatus. Also the apparatus conveniently allows for cyclical variation of the force exerted on the rib cage area without the need for attachment to a stretching table as according to the prior art.

The foregoing description of the invention has been directed to a particular preferred embodiment in accordance with the requirements of the patent statutes and for purposes of explanation and illustration. It will be apparent to those skilled in this art that many modifications and changes in both apparatus and method of the present invention may be made without departing from the scope and spirit of the invention. For example, the pivotal attachment of the struts 14 to each corselet 12 could instead be a hinged attachment, with the extension of the length of the struts 14 being solely a function of moving the feet 18, and with the freedom of movement of the wearer to bend at the waist being a function of the curved foot surface contacting the surface on which the wearer is seated, or resting in the pouch. Also, the pivotal attachment 95 could be removed, as noted, or left as shown in this application, and, in either event, the feet 18 can be shaped to rest flatly on the surface on which the wearer is seated, i.e., designed not to rock back and forth on, e.g., a curved surface. Various shapes are possible for the feet 18 and the contacting surfaces thereof. Various means are available for adjusting the position of each foot 18 on its strut 14. Other means could be used to adjust the length of the struts 14 and to lock the struts 14 to that length. The corselets could be formed as panels in a corset which the wearer places on the body to encase the entire lower torso. These and other similar modifications of the invention will be apparent to those skilled in the art. It is the Applicants' intention to cover in the following claims all such equivalent modifications and variations as fall within the true spirit and scope of the invention.

What is claimed is:

1. A spinal compression relieving and stretching apparatus comprising:

a first and a second corselet, each contoured generally to fit on the sides of the lower torso of the wearer of the apparatus; and a first and a second strut, each pivotally attached to a respective one of the corselets, and extending in the direction of the hips of the wearer, each of a sufficient length to extend to contact a surface upon which the wearer is sitting when the wearer is in, the sitting position, and to exert a suspending force on the corselets at generally the lower rib cage of the wearer the pivotal attachment of the struts to the corselets permitting rotation of the torso by forward and backward rocking motion by the wearer.

2. The apparatus of claim 1 further comprising:

a foot at the terminal end of each strut for engaging the surface on which the wearer is sitting or standing; and the attachment of the each of the first and second struts to its respective corselet includes a length adjusting apparatus with a means for selectively adjusting the length of the strut between the length adjusting apparatus and the foot, and for locking the strut to that selected length.

3. The apparatus of claim 2 further comprising:

a holding strap having at either end thereof a pouch, and having a sufficient length for each pouch to extend over the respective edge of a seat in which the wearer is sitting, such that each pouch extends substantially vertically at the respective edge of the seat, with each pouch of a size sufficient to receive and hold a respective foot.

4. The apparatus of claim 2 further comprising:

a pair of pouch suspension straps each having a hooking member at one end thereof, whereby the suspension strap is hooked over a respective arm of an armchair in which the wearer is sitting, and at the other end thereof a pouch of sufficient size to receive and hold a respective foot.

5. The apparatus of claim 4 further comprising:

force exerting means for selectively applying and releasing a force on each of the respective pouches in a direction decreasing the horizontal distance between the pouches.

6. The apparatus of claim 2 wherein the terminal end of each foot is a curved surface.

7. The apparatus of claim 2 further comprising:

a cleat mounted on each foot; and a strap having at each end thereof at least one cleat-receiving eyelet.

8. The apparatus of claim 2 further comprising:

a cleat mounted on each foot;

a pair of suspension straps each having a hooking member at one end of each, whereby the suspension strap is hooked over a respective arm of an armchair in which the wearer is sitting, and at the other end thereof at least one cleat-receiving eyelet.

* * * * *